US005259076A

United States Patent [19]

Voight et al.

[11] Patent Number: 5,259,076

[45] Date of Patent: Nov. 9, 1993

[54] WINTERIZING DEVICE FOR INGROUND SWIMMING POOLS

[76] Inventors: Terrance R. Voight, 555 Lowe Street, Palmerston, Ontario, Canada, N0G 2P0; Wayne H. Steinfieldt, 137 King Street East, Linwood, Ontario, Canada, N0B 2A0; H. Dermot Sweeny, 142 Stoneybrook Dr., Kitchener, Ontario, Canada, N2H 4L7

[21] Appl. No.: 850,987

[22] Filed: Mar. 12, 1992

[51] Int. Cl.[5] ..... E04H 4/14

[52] U.S. Cl. ..... 4/496; 4/504

[58] Field of Search ..... 4/496, 504; 114/227, 114/228, 229; 405/11, 12, 13, 14

[56] References Cited

U.S. PATENT DOCUMENTS

| | | | |
|---|---|---|---|
| 3,858,597 | 1/1975 | Pramenko | 4/510 X |
| 4,092,746 | 6/1978 | Harris | 4/507 |
| 4,175,510 | 11/1979 | Devine | 405/12 X |
| 4,368,550 | 1/1983 | Stevens | 4/507 |
| 4,752,979 | 6/1988 | Goacher, Sr. | 4/496 |
| 5,060,321 | 10/1991 | Breneisen | 4/496 |

OTHER PUBLICATIONS

*Scientific American*, "Repairing of Tanks and Reservoirs", Nov. 27, 1886 p. 344.

Brochure published by Jacuzzi Canada, Ltd. Rexdale, Ontario, Canada, Sep. 1, 1977.

*Primary Examiner*—William A. Cuchlinski, Jr.

*Assistant Examiner*—W. Morris Worth

*Attorney, Agent, or Firm*—Jones, Tullar & Cooper

[57] ABSTRACT

A device for use in winterizing inground swimming pools avoids the necessity of draining the pool in order to drain underground water-filled conduits before freeze-up. The device is an elongated cofferdam open at top and rear with a groove for receiving a sealant extending along the rear edge of side and bottom walls. The sealant, such as a denture adhesive, will hold the device against the pool side wall surrounding a water inlet, and so that the device opens above the water surface. Water within the device and the conduit leading to the inlet is pumped therefrom and then a plug is inserted in the inlet to prevent pool water from entering the inlet after the device is removed from the pool side wall.

14 Claims, 3 Drawing Sheets

40
42
44
46
48
50
52
54
56
58
62
64
66
96

WINTERIZING DEVICE FOR INGROUND SWIMMING POOLS

This invention relates to inground swimming pools in general and, in particular, to a device that can save a substantial amount of water during the pool winterizing process.

BACKGROUND OF THE INVENTION

In areas of the country subjected to freezing wintertime temperatures it is necessary to prepare inground swimming pools for such temperatures in order to avoid extensive damage, particularly to those pipes and conduits that are buried in the ground but above the frost line. Water left in those pipes and conduits will freeze and expand, damaging the pipes and fittings. Normally the winterizing process involves the steps of draining water from all pipes situated above the frost line, closing exposed openings in the pool side wall to prevent ingress of water, debris, rain or snow, and removing or protecting outside mechanical equipment.

In most installations the water inlets into the pool are situated well below the normal water line, perhaps by as much as 30 to 50 cm. With standard winterization procedures, often taking from 6 to 8 hours depending on the pool size, one must first of all reduce the water level to below the inlets so that the water remaining in the pipes above the frost line can be drained therefrom without fear of replacement water entering via the inlets. Draining to that level can involve the removal of several thousand liters of water from a typical residential swimming pool, perhaps as much as 25,000 liters. In addition to being a wastage of water, the drained water usually is fed into a neighbourhood storm sewer system. When many pool owners are winterizing at the same time the sewer system can be severely loaded by such pool drainage water. Also, storm sewer water is not normally treated and the chemicals used in swimming pool water can be harmful to the environment. Additionally, the drained water must be replaced after winterizing is complete to protect the pool structure from winter damage. It is therefore desirable to reduce, as much as possible, the volume of water that must be drained from pool during the winterization process.

SUMMARY OF THE INVENTION

The present invention provides a simple yet effective device that can be used by the pool owner or service personnel during winterizing to almost eliminate the necessity of draining water from the pool. The invention acts like a cofferdam to isolate each inlet in turn from the surrounding water so that water within the cofferdam can be pumped therefrom and the water residing within the pipes leading to the inlets can be removed. After all the water has been pumped from those pipes the inlets can be plugged and the cofferdam removed from the pool, the plug preventing any surrounding water from entering the inlet.

The device of this invention takes the form of a trough having side walls and a front wall, and being closed at one end by a bottom wall. It will be typically utilized in an upright orientation with the bottom wall at the lower end. In this attitude the device is open at the rear and at the top.

The rear edges of the side and bottom walls are grooved to receive a suitable sealant or adhesive which is used to secure the device to the pool wall during winterizing. The sealant must be a material that will attach the device to the pool side wall in the presence of water. Normal water pressure will, of course, help to hold the cofferdam in place. It must also allow removal of the device without undue force being applied thereto. Furthermore, it must be of such a nature that any residue adhering to the pool side wall, as well as to the device itself, can be removed without difficulty. It has been found that an excellent sealant/adhesive has a formulation similar to that of adhesives used by denture wearers to secure dentures within the mouth. A typical adhesive is that sold under the trade mark "POLIDENT". Since manufacturers of such adhesives may often have batches that do not meet the strict standards for use within the human body it is believed that such manufacturers could provide non-standard adhesive material suitably packaged for sale with the device of this invention.

By utilizing the device of this invention the pool owner needs to drain only a small volume of water from the pool for winterizing. He thus is helping to protect the environment; he is wasting much less water than before; and he will spend much less time, typically one hour or so, actually going through the winterizing process.

Broadly speaking, therefore, the present invention may be considered as providing a device for use when winterizing an inground swimming pool having side and bottom walls, a water drain in the bottom wall, water inlet means in at least one of the pool side walls below the normal water line, a circulation pump, first conduit means connecting the drain with the pump, and second conduit means connecting the pump with the inlet means, the device comprising: elongated cofferdam means having side, front and bottom walls; sealant receiving means extending along rear edges of the cofferdam side and bottom walls; and a sealant receivable in the sealant receiving means, the sealant being capable of temporarily adhering the cofferdam means to the pool side wall about the inlet means during winterizing; whereby with the cofferdam means adhered to the pool side wall about the inlet means one can apply a vacuum hose to water initially residing in the cofferdam means to remove such water therefrom and to subsequently drain water from the second conduit means.

Furthermore, this invention contemplates a method of winterizing an inground swimming pool having side and bottom walls, a water drain in the bottom wall, water inlet means in one of the pool side walls below the normal water line, a circulation pump, a water skimmer in one of the pool side walls, first conduit means connecting the drain to the pump, and second conduit means connecting the pump to the inlet means, comprising the steps of: operating the pump in a drain mode thereof to reduce the level of water in the pool to below the skimmer; applying a sealant to the rear edges of cofferdam means having side, front and bottom walls; applying the cofferdam means to the pool side wall with the bottom wall of the cofferdam means below the inlet means, the side walls of the cofferdam means being outboard of the inlet means, and the cofferdam means reaching to above the lowered water level; plugging any other inlet means to the swimming pool; inserting one end of a vacuum hose into the cofferdam means and pumping therefrom water trapped therein and water flowing from the second conduit into the cofferdam means; plugging the inlet means at the completion of the pumping step; and removing the cofferdam from the pool side wall.

DESCRIPTION OF THE PREFERRED EMBODIMENT

Figure 1:
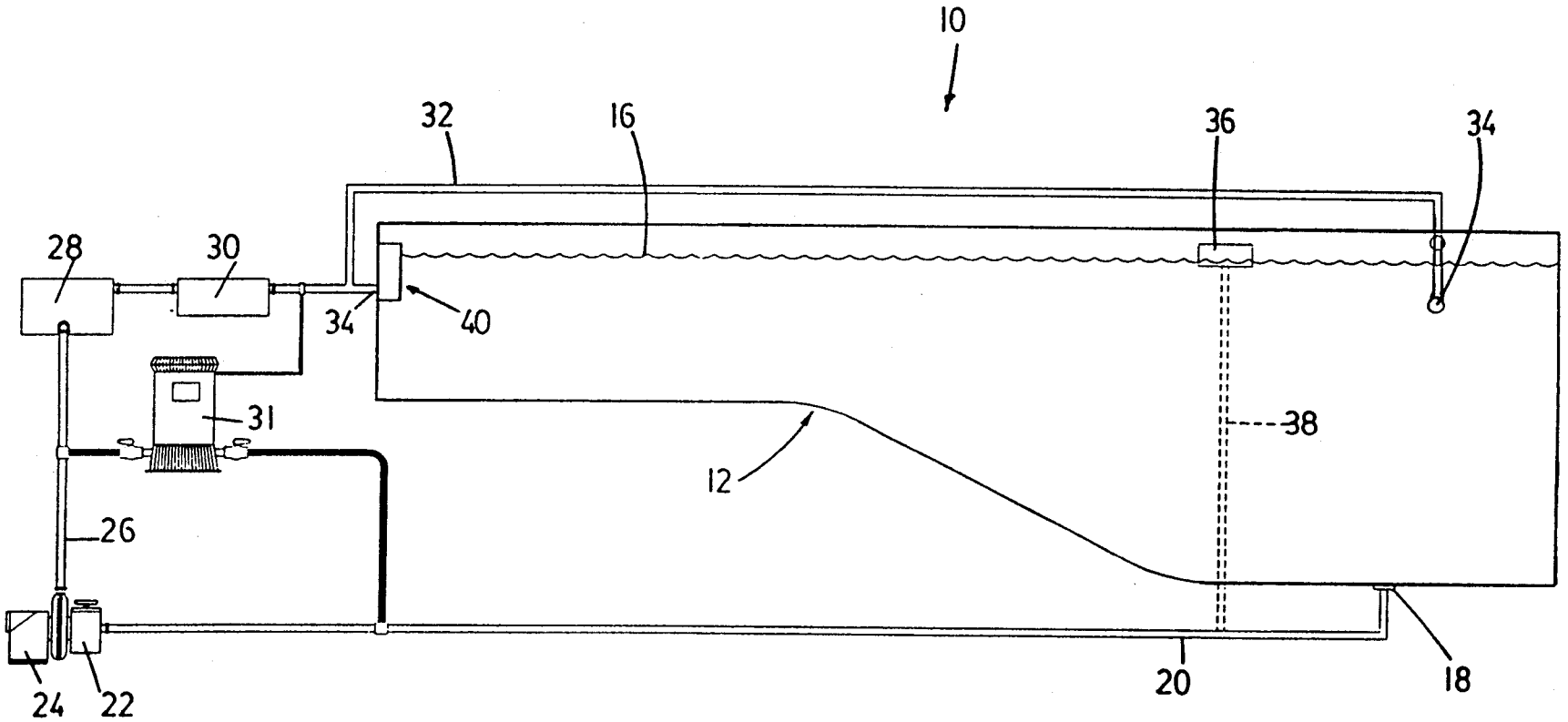
FIG. 1 shows a side view of a typical inground swimming pool installation with the cofferdam device of this invention in place.

FIG. 1 illustrates generally a typical inground swimming pool installation with which the present invention is particularly useful. A pool 10 has a shallow end 12, a deep end 14, and a normal water line 16, a typical pool containing about 200,000 liters of water. The pool system includes means for circulating the pool water, the system including as well means for filtering and heating the water. The circulating system includes a drain 18 in the deep end 14, a buried pipe or conduit 20 leading to a lint trap 22 and a circulation pump 24, a conduit 26 leading to a filter 28 and then to a heater 30, and a buried conduit or pipe 32 leading to one or more water inlets 34 in the pool side wall. The inlets 34 may be from 25 to 45 cm. below the pool lip, perhaps as much as 30 cm. below the normal water line 16. A chlorinator 31 may be provided, connected to the conduits 20 and 26.

FIG. 1 is schematic in nature and does not illustrate the exact location of the conduits and the pool equipment. For example, the hardware, such as the pump 24, lint trap 22, filter 28, heater 30 and chlorinator 31, would probably be housed in a shed (not shown) above ground while the drain conduit 20 would be buried over most of its length below the frost line. The inlet conduit 32, however, would be buried above the frost line and any water therein would be subject to freezing during winter conditions.

An inground swimming pool also has a skimmer 36 in the side wall, the skimmer being connected to the drain conduit 20 by a descending conduit 38. The skimmer 36 helps to maintain the water level constant with any overflow returning to the drain conduit 20 via the conduit 38.

Figures 2, 3, 4, 5, 10:
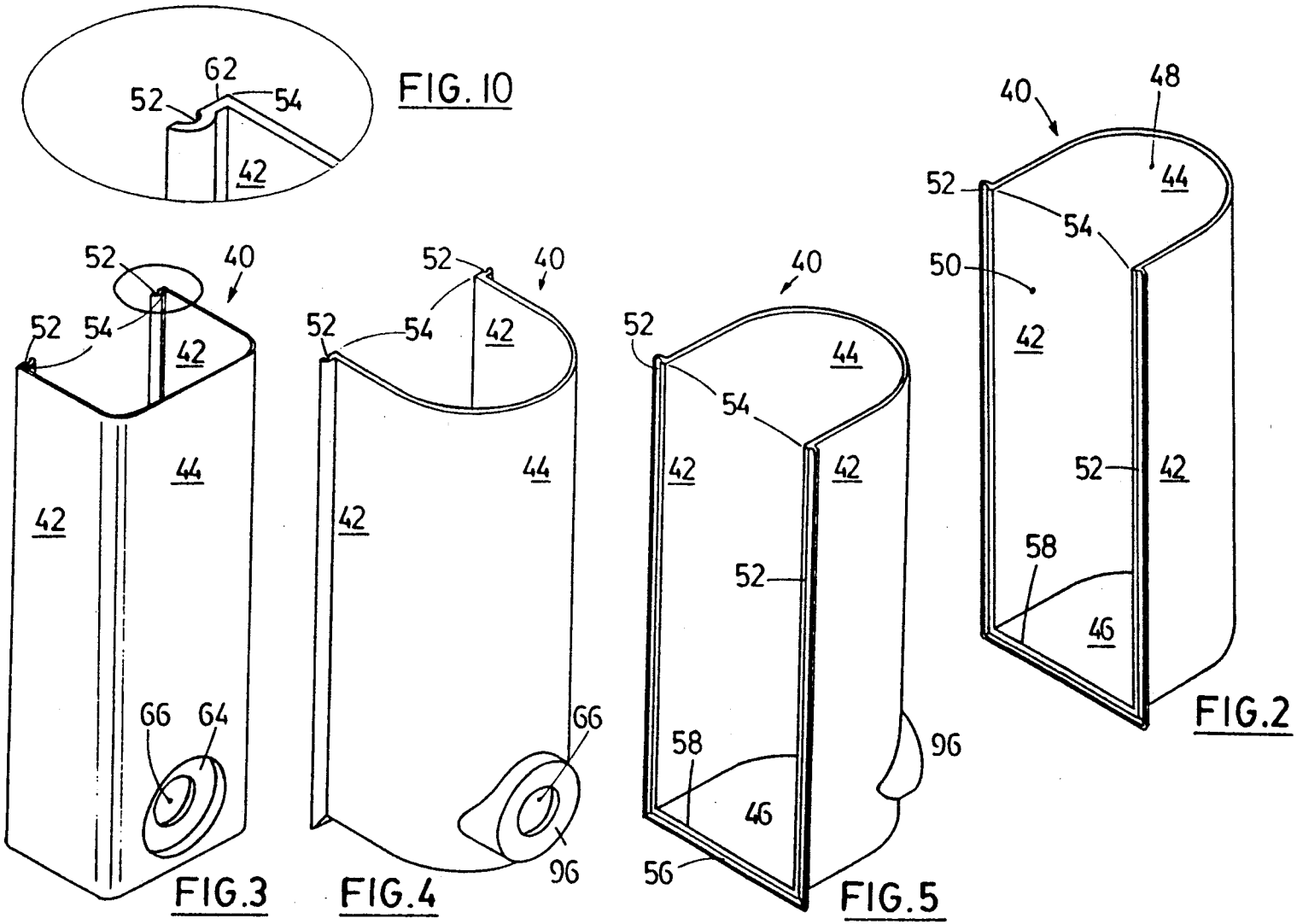
FIG. 2 shows a rear perspective view of a basic form of the present invention.
FIGS. 3, 4, and 6 to 8 shows perspective views of various alternative embodiments of this invention.
FIG. 5 shows a rear perspective of the device of FIG. 4.
FIGS. 9 and 10 are enlarged perspective views of the upper corner of the devices of FIGS. 3 and 6 respectively, showing the groove configuration.
Figure 7:
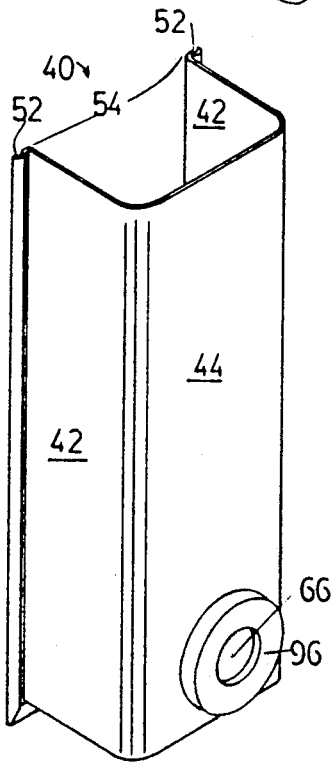
Figure 8:
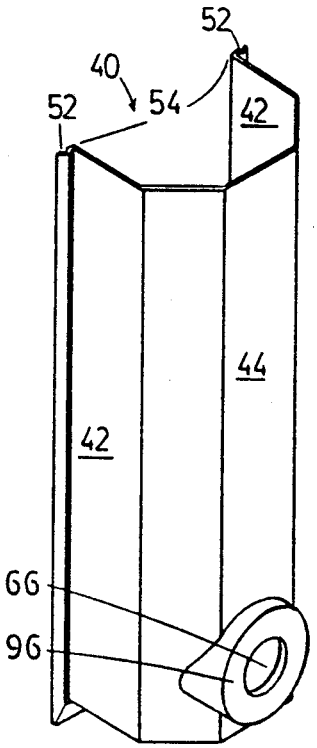

Turning now to the remaining figures the present invention will be described. With particular reference to FIG. 2 it will be seen that the present invention appears as a cofferdam 40 having side walls 42, a front wall 44, and a bottom wall 46. The cofferdam is open at the top 48 and at the rear 50. The front wall 44 may be arcuate as in FIGS. 2, 4 and 5; it may be flat as in FIGS. 3, 6 and 7; it may by polygonal as in FIG. 8; or it may take any configuration that is practical.

Figure 9:
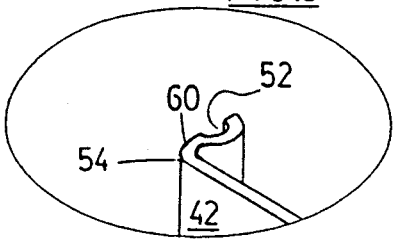

In each of the figures it will be seen that there is a groove 52 provided along the rear edge 54 of each side wall 42 and a groove 56 provided along the rear edge 58 of the bottom wall 46. With particular reference to FIGS. 9 and 10 it will be seen that the rearwardly facing grooves may be formed as part of an outwardly directed flange 60 (FIG. 9) or as part of an inwardly directed flange 62 (FIG. 10). The flange 60 or 62 will appear on the bottom wall 46 as well as on each side wall 42 so as to ensure that the groove 56 is continuous around the rear edge of the device 40.

The groove 56 is intended to receive a sealant for temporarily adhering the device 40 to a pool side wall 12. The sealant must have certain properties, including the ability to secure the cofferdam 40 to the pool side wall in the presence of water. It must also allow the cofferdam to be removed without undue difficulty and it must be such that it is easily cleaned from the pool side wall, if necessary, or from the device itself. Extensive research has shown that a suitable material is the adhesive that a denture wearer would use to secure dentures within the mouth. Such a material is formulated to be adhesively effective in a moist environment but it also allows removal of the adhered denture without undue effort. A denture adhesive such as is available under the trade mark "POLIDENT" has been found to work very well with the present invention. Manufacturers of such adhesives occasionally find that they have produced product that does not meet the stringent standards set by government health agencies and such nonstandard product could be packaged for sale with this invention rather than being destroyed.

In order to winterize a pool 10 the owner will first of all lower the water level to just below that of the skimmer 36 so that no water will flow into the skimmer. This will involve lowering the level by only a few centimeters. He will then apply sealant to the groove 56 around the rear edge of a cofferdam 40 of this invention and he will then apply the cofferdam 40 to the pool side wall as seen in FIG. 1. The cofferdam 40 of the present invention is positioned with the bottom wall 46 located below the water inlet 34 and the side walls 42 outboard of the inlet. The cofferdam 40 extends to above the water line. In order to winterize the pool the owner next inserts his vacuum hose into the open upper end 48 cofferdam 40 and operates his pump until the water trapped in the cofferdam 40 is removed, along with any water that flows into the cofferdam from the inlet 34 and the second conduit 32.

Once there is no more water being sucked from the conduit 32 the owner removes the vacuum hose from the cofferdam 40 and inserts a standard plug (not shown) into the inlet 34. He can do this by reaching down into the cofferdam 40 from the open upper end 48 and threading or otherwise inserting the plug into the inlet. The cofferdam 40 is of such a size that an adult can insert his arm and can manoeuvre his hand therein, even with a spanner or any other tool that may be required to insert the plug into the insert.

Once the winterizing process is complete the cofferdam 40 is twisted and pulled from the pool side wall and any sealant residue washed therefrom. The water level can be raised again if desired or it can be left at its slightly lowered level until spring.

If the pool has more than one inlet 34 it would be necessary to initially plug all but one inlet, with the cofferdam 40 being applied about the last, unplugged, inlet for water removal. The same procedure could be followed for the other inlets to ensure water removal from the conduits leading thereto.

The foregoing has described the basic form of this invention. FIGS. 3 to 8 and 11 to 13 illustrate embodiments which are more convenient to use in that they provide a connection for the vacuum hose, meaning that the hose need not be inserted directly into the cofferdam 40, as is the case with the basic embodiment of FIG. 2. When the hose is not located within the cofferdam device the pool owner can work inside the cofferdam 40, as with the inlet plug, while the pump is still operating and water is being drawn from the cofferdam 40 and the conduit 32.

Figure 6:
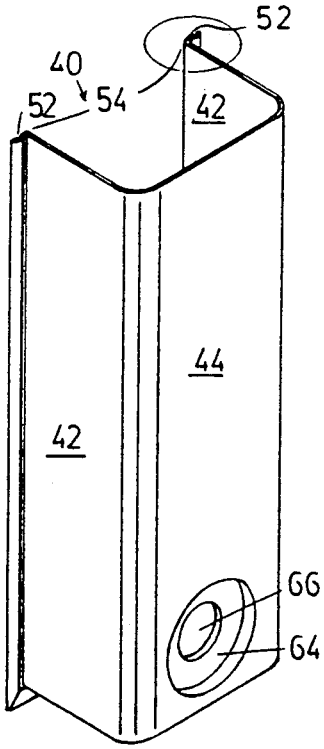

In the embodiment of FIGS. 3 and 6 the cofferdam 40 has a circular recess 64 in the front wall 44 (or in the side wall 42) surrounding a circular opening 66 adjacent the bottom wall 46. An insert 68 shown in FIGS. 11 and 12 can be thrust into the opening 66 and sealed thereto, with the vacuum hose being connectable to the insert. The insert 68 has a cylindrical body 70, an annular flange 72 receivable in the recess 64, a short cylindrical locking portion 74, a frustoconical skirt 76 and an opening 78 in the body 70. Preferably, the opening 66 has a frustoconical surround 80 which, when the insert 68 is thrust into the opening 66, will abut against the rear edge 82 of the skirt 76 to hold the insert in place.

A narrow rib 84 is provided on the body 70 to help hold a valve closure member 86 in position on the body 70, the member 86 being rotatable on the body 70 and having an opening 88 corresponding to the opening 78 in the body 70. By rotating the member 86 relative to the body 70 one can control the vacuum level being applied to the cofferdam 40 when the vacuum hose is connected to the insert 68, in the event that vacuum pressure is excessive, and to prevent the loss of prime at the pump.

Figure 11:
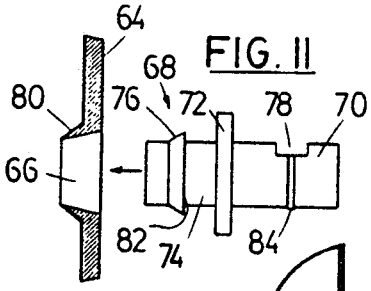
FIGS. 11, 12 and 13 are exploded views of various vacuum hose connections that can be used with the embodiments of FIGS. 3 to 7.
Figure 12:
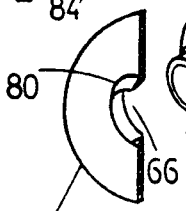
Figure 12:
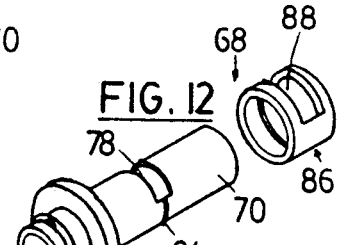
Figure 13:
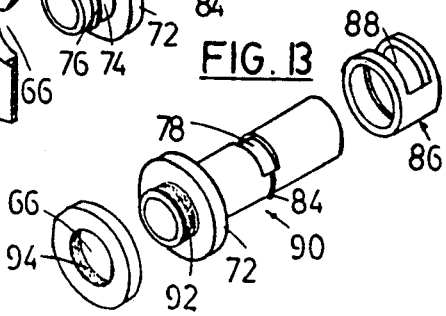

The insert 90 of FIG. 13 operates in the same manner as the insert 68 but it can be attached to the cofferdam 40 by a threaded connection rather than by the bayonet connection of FIGS. 11 and 12. In this case the insert 90 has a threaded end 92 adjacent the flange 72 and the opening 66 in the cofferdam 40 is also threaded, as at 94, to receive the threaded end 92.

In FIGS. 4, 5, 7 and 8 the opening 66 is provided in a raised boss 96 on the front wall 44 of the cofferdam 40. The opening 66 can be threaded as in FIG. 13 or it can have a surround 80 as in FIGS. 11 and 12. The boss 96 can be integrally molded with the cofferdam 40 or it can be attached thereto subsequently in a suitable manner, either by the manufacturer or by the pool owner. For ease of packaging, the insert 68 or 90 would be provided separately, for mating with the cofferdam 40 by the pool owner prior to utilization thereof.

The cofferdam 40 of this invention is simple to use and inexpensive to manufacture, preferably from a suitable plastics material (including recycled plastics) yet it provides a significant advantage to the pool owner in the reduction of time and water wasted during the winterizing process. It also provides an advantage to the municipality by reducing the amount of water drained in the storm sewer system and by reducing the volume of untreated, chlorine-containing water released to community water systems, streams and rivers. Perhaps, even, some municipalities could be persuaded to reduce the normal sewage surcharge that they apply to pool owners if the pool owner were to utilize the present invention so as to reduce the volume of water entering the sewer system.

While the foregoing has described the basic form of the invention and certain alternative embodiments it is clear that a skilled person could alter the form of the invention without departing from the spirit thereof. Thus the protection to be afforded this invention should be determined from the claims appended hereto.

We claim:

1. A device for use when winterizing an inground swimming pool having side and bottom walls, a water drain in said bottom wall, at least one water inlet in at least one of said pool side walls below the normal water line, a circulation pump, first conduit means connecting said drain with said pump, and second conduit means connecting said pump with said at least one inlet, said device comprising:

an elongated cofferdam having side, front and bottom walls; means for receiving a sealant extending along the rear edge of said cofferdam side and bottom walls;

a sealant receivable in said sealant receiving means, said sealant being capable of adhering said cofferdam to the pool side wall in the presence of water, can release from the pool side wall without the application of undue force applied to said cofferdam, and any residue thereof can be easily washed from the pool side wall;

an opening in one of said side and front walls adjacent said bottom wall of the cofferdam; and an insert receivable in said opening and having means to receive a free end of a vacuum hose, said opening being surrounded by a recess in said one of said side and bottom walls, and said insert including a cylindrical body having an end receivable in said opening, and annular flange receivable in said recess, a valve opening, and a valve member rotatable on said body to open and close said valve opening; whereby with said cofferdam adhered to the pool side wall about the inlet one can apply said vacuum hose to water initially residing in the cofferdam to remove such water therefrom and to subsequently drain water from said second conduit means.

2. A device according to claim 1 including plug means for sealing said inlet means against water ingress following removal of said cofferdam means after winterizing.

3. A device according to claim 1 wherein said sealant is an adhesive normally used for the retention of dentures within a denture wearer's mouth.

4. A device according to claim 1 wherein said front wall of the cofferdam is arcuate, merging smoothly with each of said side walls.

5. A device according to claim 1 wherein said opening is threaded and said receivable end of the cylindrical body is threaded for threaded reception in said opening.

6. A device according to claim 1 wherein said receivable end of the cylindrical body has a frustoconical skirt thereon for locking engagement with a frustoconical surround about said opening.

7. A device for use when winterizing an inground swimming pool having side and bottom walls, a water drain in said bottom wall, at least one water inlet in at least one of said pool side walls below the normal water line, a circulation pump, first conduit means connecting said drain with said pump, and second conduit means connecting said pump with said at least one inlet, said apparatus comprising:

an elongated cofferdam having a pair of side walls, a front wall, and a bottom wall, said cofferdam having a length to reach from below said at least one inlet to above said normal water line;

a groove extending along a rear edge of each of said cofferdam side walls and said cofferdam bottom wall;

a sealant receivable in said groove, said sealant being capable of adhering said cofferdam to the pool side wall in the presence of water during said winterizing and of releasing said cofferdam from the pool side wall following winterizing;

an opening in one of said side and front walls adjacent said bottom wall of said cofferdam; and an insert receivable in said opening and having means to receive a free end of a vacuum hose, said opening being surrounded by a recess in one of said side and bottom walls, and said insert including a cylindrical body having an end receivable in said opening, an annular flange receivable in said recess, a valve opening, and a valve member rotatable one said body to open and close said valve opening;

whereby with said cofferdam adhered to the pool side wall about said at least one inlet one can apply said vacuum hose to remove water initially in the cofferdam and to subsequently drain water from said second conduit means.

8. A device according to claim 7, wherein said at least one inlet is sealable against water ingress following removal of said cofferdam after winterizing.

9. A device according to claim 7 wherein said sealant is an adhesive normally used for the retention of dentures within a denture wearer's mouth.

10. A device according to claim 7 wherein said front wall of the cofferdam is arcuate, merging smoothly with each of said side walls.

11. A device according to claim 7 wherein said opening is threaded and said receivable end of the cylindrical body is threaded for threaded reception in said opening.

12. A device according to claim 7 wherein said receivable end of the cylindrical body has a frustoconical skirt thereon for locking engagement with a frustoconical surround about said opening.

13. A device for use when winterizing an inground swimming pool having side and bottom walls, a water drain in said bottom pool having side and bottom walls, a water drain in said bottom wall, at least one water inlet in at least one of said pool side walls below the normal water line, a circulation pump, first conduit means connecting said drain with said pump, and second conduit means connecting said pump with said at least one inlet, said device comprising;

elongated cofferdam having side, front and bottom walls;

means for receiving a sealant extending along the rear edge of said cofferdam side and bottom walls;

a sealant receivable in said sealant receiving means, wherein said sealant is capable of adhering said cofferdam to pool side wall in the presence of water, can release from the pool side wall without the application of undue force applied to said cofferdam, and any residue thereof can be easily washed from the pool side wall;

an opening in one of said side and front walls adjacent said bottom wall of the cofferdam; and an insert receivable in said opening and having means to receive a free end of a vacuum hose, said opening being provided in a boss on said side or front wall and said insert including a cylindrical body having an end receivable in said opening, a valve opening, and a valve member rotatable on said body to open and close said valve opening;

whereby with said cofferdam adhered to the pool side wall about said at least one inlet one can apply said vacuum hose to water initially residing in the cofferdam to remove such water therefrom and to subsequently drain water from said second conduit means.

14. A device for use when winterizing an inground swimming pool having side and bottom walls, a water drain in said bottom wall, at least one water inlet in at least one of said pool side walls below the normal water line, a circulation pump, first conduit means connecting said drain with said pump, and second conduit means connecting said pump with said at least one inlet, said apparatus comprising;

an elongated cofferdam having a pair of side walls, a front wall, and a bottom wall, said cofferdam having a length to reach from below said inlet means to above said normal water line;

a groove extending along a rear edge of each of said cofferdam side walls and said cofferdam bottom wall;

a sealant receivable in said groove, said sealant being capable of adhering said cofferdam to the pool side wall in the presence of water during said winterizing and of releasing said cofferdam from the pools side wall following winterizing;

an opening in one of said side or front walls adjacent said bottom wall of the cofferdam; and an insert receivable in said opening and having means to receive a free end of a vacuum hose, said opening being provided in a boss on said side or front wall and wherein said insert includes a cylindrical body having an end receivable in said opening, a valve opening, and a valve member rotatable on said body to open and close said valve opening;

whereby with said cofferdam adhered to the pool side wall about said at least one inlet one can apply said vacuum hose to remove water initially residing in the cofferdam and to subsequently drain water from said second conduit means.

* * * * *